US011413630B2

(12) United States Patent
Nagasu

(10) Patent No.: US 11,413,630 B2
(45) Date of Patent: Aug. 16, 2022

(54) CENTRIFUGAL APPARATUS HAVING A BOWL WITH EXTENSION LUGS AND WEAR-RESISTANT SLEEVES

(71) Applicant: TOMOE ENGINEERING CO., LTD., Tokyo (JP)

(72) Inventor: Masaru Nagasu, Tokyo (JP)

(73) Assignee: TOMOE ENGINEERING CO., LTD., Tokyo (JP)

( * ) Notice: Subject to any disclaimer, the term of this patent is extended or adjusted under 35 U.S.C. 154(b) by 349 days.

(21) Appl. No.: 16/721,225

(22) Filed: Dec. 19, 2019

(65) Prior Publication Data

US 2020/0246809 A1 Aug. 6, 2020

(30) Foreign Application Priority Data

Jan. 31, 2019 (JP) ..... JP2019-014989

(51) Int. Cl.
*B04B 1/20* (2006.01)

(52) U.S. Cl.
CPC ..... *B04B 1/20* (2013.01); *B04B 2001/2091* (2013.01)

(58) Field of Classification Search
CPC ..... B04B 1/20; B04B 2001/2091; B04B 7/00; B04B 7/08; B04B 15/00; B04B 2001/2058
USPC ..... 494/52, 56, 57, 58, 59
See application file for complete search history.

(56) References Cited

U.S. PATENT DOCUMENTS 5,244,584 A * 9/1993 Schlieperskoetter ..... B04B 7/12 494/52
7,374,529 B2 * 5/2008 Hensley ..... B04B 1/20 494/53
9,943,862 B2 4/2018 Lendzian et al.
2014/0038806 A1 2/2014 Lendzian et al.

FOREIGN PATENT DOCUMENTS

JP 61-27646 8/1986
JP 5996548 9/2016

* cited by examiner

*Primary Examiner* — Walter D. Griffin
*Assistant Examiner* — Shuyi S. Liu
(74) *Attorney, Agent, or Firm* — Wenderoth, Lind & Ponack, L.L.P.

(57) ABSTRACT

A centrifugal apparatus includes: a bowl including a plurality of projection portions provided in a standing manner at an edge portion of an opening portion, the plurality of projection portions each including a curved surface portion bulging toward a rotation axis; a screw conveyer; a hub forming separate matter discharge ports between the respective circumferentially adjacent projection portions; and wear-resistant sleeves. The wear-resistant sleeves each includes a sleeve body that is formed in an arched shape along the corresponding curved surface portion and covers the curved surface portion; and a claw portion including one end connected to one end portion, in a longitudinal direction perpendicular to the axis direction, of the sleeve body. The claw portion is in contact with an outer surface of the corresponding projection portion and fixed to the outer surface via a detachable tool for fixing, and an insertion opening for inserting the projection portion.

8 Claims, 8 Drawing Sheets

CENTRIFUGAL APPARATUS HAVING A BOWL WITH EXTENSION LUGS AND WEAR-RESISTANT SLEEVES

TECHNICAL FIELD

The present invention relates to a centrifugal apparatus and specifically relates to a wear-resistant sleeve set in a separate matter discharge port of a bowl.

BACKGROUND ART

As centrifugal apparatuses that centrifuge a processing subject in a solid-liquid mixed state, decanters have been known (for example, Patent Literature 1). FIG. 1 is a diagram illustrating an example configuration of a horizontal decanter 1, including sectional illustration of the inside of a casing 2 and the inside of a bowl 3. The configuration and problems of the decanter 1 will briefly be described below. A supplementary description of the configuration of the decanter 1 will be provided in an embodiment described later.

The decanter 1 includes the casing 2, the tubular bowl 3 housed in the casing 2 and a screw conveyer 4 housed in the bowl 3. The bowl 3 and the screw conveyer 4 rotate around a rotation axis L at different speeds.

A processing subject is supplied into the screw conveyer 4 from a processing subject supply port 81. The processing subject is discharged into the bowl 3 from processing subject passageways 41 formed in a wall surface of the screw conveyer 4. In the bowl 3, the processing subject is centrifugally separated into separate liquid and solid matter by operation of the bowl 3 and the screw conveyer 4. As a result of the operation of the bowl 3 and the screw conveyer 4, the separate liquid is conveyed to the left side in FIG. 1 inside the bowl 3. Then, the separate liquid is discharged into the casing 2 from separate liquid discharge ports 31 and then discharged to the outside from the casing 2 via a separate liquid outlet 21.

The separated solid matter is conveyed to the right side in FIG. 1 in the bowl 3 by the operation of the bowl 3 and the screw conveyer 4. Then, the solid matter is discharged into the casing 2 from solid matter discharge ports 32 of the bowl 3 and then discharged to the outside from the casing 2 via a solid matter outlet 22.

Patent Literature 1 discloses a centrifugal separator including round solid matter discharge ports formed at equal intervals in a circumferential direction of an outer barrel, a wear-resistant bush being disposed in each solid matter discharge port. The centrifugal separator according to Patent Literature 1 enables replacement of bushes without disassembling the outer barrel (page 4, lines 28 and 29). Patent Literature 2 discloses a centrifugal apparatus in which a plurality of extension lugs are provided in a standing manner at an edge of an opening at an end portion of a bowl, the plurality of extension lugs being circumferentially spaced from one another, solid matter discharge ports are formed between the respective circumferentially adjacent extension lugs and liners are fastened via bolts to edges of the extension lugs forming the solid matter discharge ports. The centrifugal apparatus according to Patent Literature 2 enables ease replacement of liners by opening a casing of the centrifugal apparatus and unfastening the bolts.

However, in each of the configurations of Patent Literatures 1 and 2, of solid matter conveyed by the screw, solid matter flowing out to respective positions immediately below the solid matter discharge ports can be discharged by a centrifugal force, but solid matter flowing out to respective positions off the positions immediately below the solid matter discharge ports stick to an inner wall of an outer barrel (bowl) by the centrifugal force and thus cannot be discharged. In other words, dead spaces not used for discharge of solid matter are generated discontinuously in the circumferential direction, and thus, in order to increase an amount of discharged solid matter, it is necessary to increase a diameter of the outer barrel (bowl) to increase the opening area of each of the solid matter discharge ports.

As a countermeasure against the above problem of Patent Literatures 1 and 2, a centrifugal apparatus in which a wear-resistant plate formed in an arc shape is bonded to an inner surface of each of the extension lugs (hereinafter referred to as conventional technique 3). The centrifugal apparatus enables solid matter flowing out to the aforementioned dead spaces to be guided to the solid matter discharge ports while being slid along curved surfaces of the plates and thus enables what is called "360° discharge".

However, the centrifugal apparatus according to conventional technique 3 requires a lot of trouble in replacing the worn plates. More specifically, a preparation for plate replacement requires a lot of trouble because it is necessary to remove pipes, belts, guards and the like, take the bowl out from the casing, place the taken-out bowl on a predetermined workspace and then remove a hub as the preparation. In addition, in order to secure the workspace, e.g., a change in the layout of the inside of the plant may be inevitable. Furthermore, plate replacement work needs shaving the adhesive off and bonding new plates to the extension lugs again, and thus, takes a lot of trouble for maintenance. Also, depending on the type of solid matter, the plates may come off from the extension lugs as a result of the adhesive being dissolved.

Patent Literature 3 discloses a centrifugal apparatus that is capable of 360° discharge and has a maintenance cycle prolonged by use of bushing members having high wear resistance. In other words, the centrifugal apparatus according to Patent Literature 3 is intended to enhance wear resistance of the bushing members to prolong the maintenance cycle.

However, where a processing liquid contains solid matter having a high grinding force (for example, excavated soil and sand), even bushing members having high wear resistance are quickly worn, resulting in a decrease in maintenance cycle. Therefore, the complicated maintenance work of disassembling the centrifugal apparatus from the axis direction and replacing the bushing members needs to be performed in a short cycle.

CITATION LIST

Patent Literature

[Patent Literature 1]
Japanese Utility Model Publication No. 61-27646
[Patent Literature 2]
U.S. Pat. No. 7,374,529
[Patent Literature 3]
Japanese Patent No. 5996548

SUMMARY OF INVENTION

Technical Problem

An object of the present invention is to facilitate replacement of wear-resistant sleeves set in solid matter discharge ports in a centrifugal apparatus capable of 360° discharge.

Solution to Problem

In order to solve the above problem, a centrifugal apparatus according to the present invention includes: (1) a bowl including a plurality of extension lugs formed at an edge portion of an opening portion on one end side in an axis direction, the plurality of extension lugs being spaced from one another in a circumferential direction, each of the extension lugs being formed so as to bulge toward a rotation axis of the bowl; a screw conveyer that is rotatably housed inside the bowl and rotates at a rotation speed that is different from that of the bowl; a hub for forming solid matter discharge ports between the respective circumferentially adjacent extension lugs, the hub being connected to the extension lugs and covering the opening portion; and wear-resistant sleeves each including a sleeve body covering an inner surface of the corresponding extension lug, solid matter moving toward the corresponding solid matter discharge ports sliding on the inner surface, and a claw portion provided in an integrated manner on one end side of the sleeve body, the claw portion being detachably fixed via a bolt to an outer surface of the extension lug, no solid matter sliding on the outer surface.

(2) The centrifugal apparatus according to (1) above, wherein the claw portion includes a hole portion that receives a head portion of the bolt, a bottom surface of the hole portion serves as a seating surface of the head portion, the bottom surface includes a bolt hole that allows a shaft portion of the bolt to extend therethrough and the head portion of the bolt is received at a position that is lower than an upper end of the hole portion.

(3) The centrifugal apparatus according to (2) above, wherein: another end portion of the sleeve body is located on an outer side in a radial direction of the bowl relative to the outer surface and a keyway is provided in an inner surface of the other end portion; and a key that is in contact with the outer surface and fixes the other end portion of the sleeve body to the extension lug is inserted in the keyway.

(4) The centrifugal apparatus according to (3) above, wherein: in the axis direction, a width of the keyway is smaller than a width of the sleeve body; and a thickened portion having a width corresponding to the width of the keyway is formed on the other end side of the sleeve body.

(5) The centrifugal apparatus according to any one of (1) to (4) above, wherein the claw portion includes an inclined surface in which a front end portion in a direction of rotation of the bowl is close to the rotation axis relative to a rear end portion.

Advantageous Effects of Invention

The present invention enables solid matter discharged to the vicinities of inner surfaces of the extension lugs to be guided to the solid matter discharge ports while being slid along the wear-resistant sleeves and thus enables discharge of both solid matter flowing out to positions immediately below the solid matter discharge ports and solid matter flowing out to positions off the positions immediately below the solid matter discharge ports from the solid matter discharge ports (360° discharge). Consequently, the need for increasing a diameter of the bowl to increase an amount of discharged solid matter is eliminated. Also, the wear-resistant sleeves can be replaced merely by opening a casing of the centrifugal apparatus and unfastening the bolts. Since there is no need to disassemble the centrifugal apparatus from the axis direction in replacement of the wear-resistant sleeves, a burden of maintenance work is reduced.

DESCRIPTION OF EMBODIMENTS

First Embodiment

Figure 1:
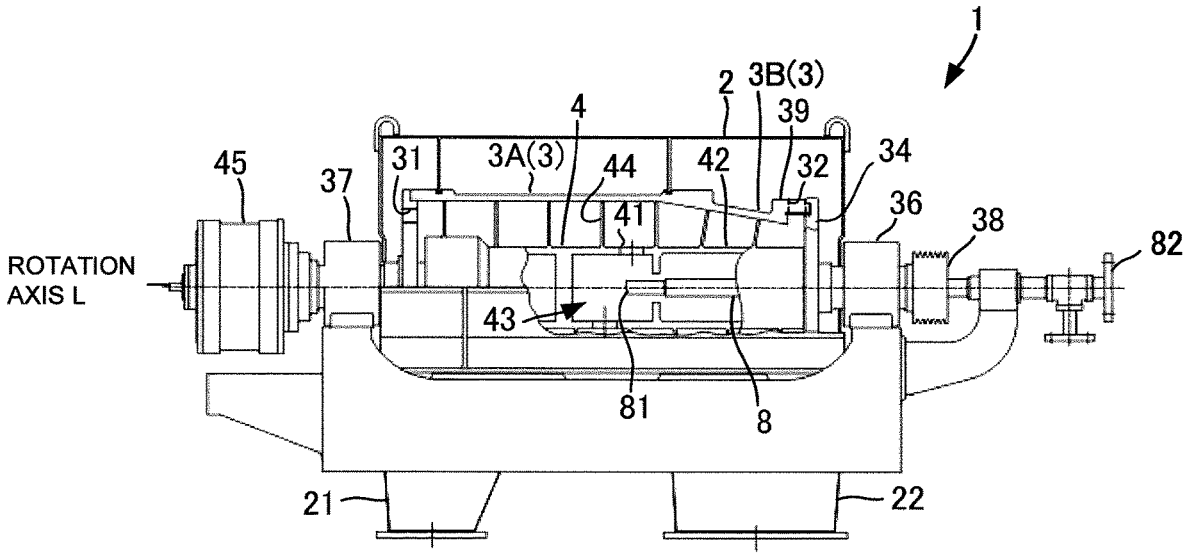
FIG. 1 is a diagram illustrating an example configuration of a horizontal decanter.

A centrifugal apparatus that is a preferable embodiment of the present invention will be described taking a horizontal decanter 1 in FIG. 1 as an example. A configuration of wear-resistant sleeves 5 (FIG. 2) in the decanter 1 is different from those of conventional techniques. Interpretation of the technical scope of the present invention is not limited in any way by the below-described embodiments.

Figure 8:
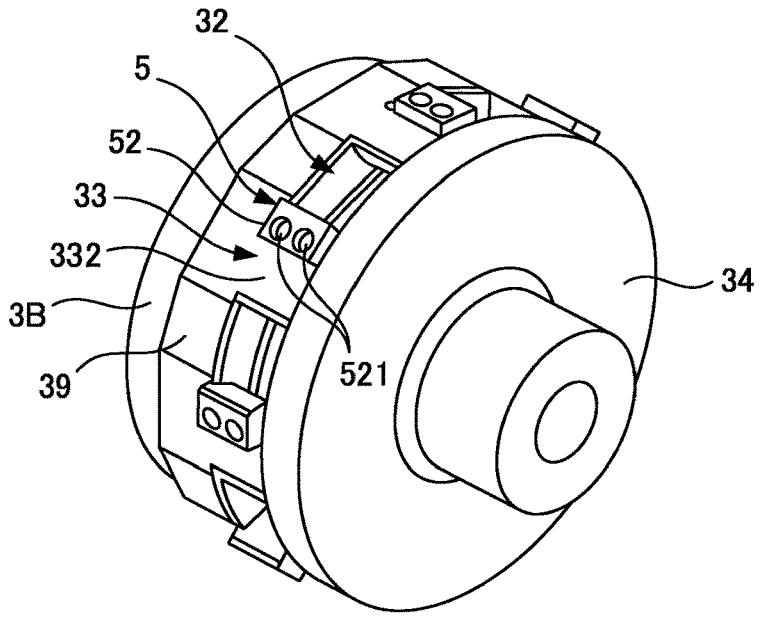
FIG. 8 is a perspective diagram illustrating a state in which wear-resistant sleeves are attached to respective lugs.

The decanter 1 includes a casing 2, a bowl 3 and a screw conveyer 4. The casing 2 houses the bowl 3 and the screw conveyer 4. The casing 2 is configured so as to be opened and closed, and upon the casing 2 being opened, as illustrated in FIG. 8 described later, the bowl 3, solid matter discharge ports 32, wear-resistant sleeves 5, a hub 34, etc., can be viewed. The bowl 3 is configured by a bowl shell 3A and a bowl extension 3B. The bowl shell 3A is formed in a cylindrical shape having a constant inner diameter. The bowl extension 3B is formed in a truncated conical shape. The bowl shell 3A and the bowl extension 3B are joined via non-illustrated bolts. However, the present invention is applicable also to a bowl 3 including a bowl extension 3B having a constant inner diameter. The plurality of solid matter discharge ports 32 are provided on one end side of the bowl 3. A plurality of separate liquid discharge ports 31 are provided on the other end side (left side in FIG. 1) of the bowl 3.

A shaft portion on the one end side of the bowl 3 is rotatably supported by a bearing 36 and a shaft portion on the other end side is rotatably supported by a bearing 37. The bowl 3 rotates as a result of the shaft portion on the one end side being driven by a pulley 38.

The screw conveyer 4 is rotatably held and housed in the bowl 3. A processing subject supply chamber 43 is formed in a barrel portion 42 of the screw conveyer 4. A processing subject supply port 81, which is an end portion of a supply tube 8, is disposed in the processing subject supply chamber 43. The supply tube 8, which extends toward the one end side (right side in FIG. 1) in a rotation axis L direction of the bowl 3, extends to the outside of the casing 2 through the inside of the bearing 36 and the inside of the pulley 38. A processing subject, which is an object to be centrifuged, is supplied to a processing subject inlet 82, which is an end portion of the supply tube 8 disposed outside of the casing 2. The processing subject passes through the supply tube 8 and is supplied into the processing subject supply chamber 43 from the processing subject supply port 81.

The processing subject may be any of various solid-liquid mixtures that can be separated into solid and liquid by centrifugation. The present invention is particularly favorable for separate liquids containing excavated solid and sand, which have a high grinding force. Here, it is a matter of course that the present invention is favorable also for separate liquids containing abrasive particles such as metal hydroxide particle-contained slurry and coal particle-contained slurry.

The processing subject proceeds inside the bowl 3 by passing through a plurality of processing subject passageways 41 formed in an outer circumferential surface of the processing subject supply chamber 43.

A helical screw blade 44 is formed at an outer circumferential surface of the barrel portion 42. The screw conveyer 4 rotates at a rotation speed that is different from that of the bowl 3, as a result of motive power being transmitted from a gearbox 45. For the gearbox 43, for example, a planetary gear can be used.

As a result of the screw conveyer 4 rotating with the difference in speed from the bowl 3, the processing subject is centrifugally separated into separate liquid and solid matter (separate matter), jointly with the bowl 3. The separate liquid proceeds to the other end side inside the bowl 3 by means of operation of the bowl 3 and the screw conveyer 4, is discharged into the casing 2 from the separate liquid discharge ports 31 and then discharged to the outside from the inside of the casing 2 via a separate liquid outlet 21.

The screw conveyer 4 conveys the solid matter provided with a centrifugal force inside the bowl 3 to the one end side of the bowl 3. The solid matter is discharged into the casing 2 from the solid matter discharge ports 32 on the one end side of the bowl 3 and then discharged to the outside from the inside of the casing 2 via a solid matter outlet 22.

Figure 2:
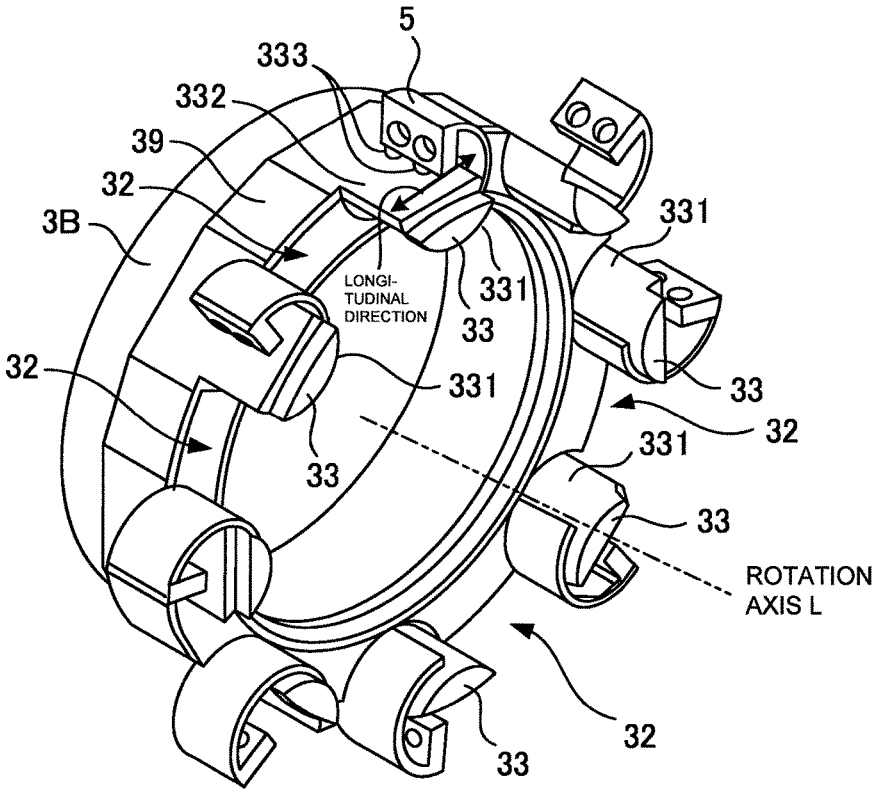
FIG. 2 is an enlarged side view of an opening portion on one end side in a direction of a rotation axis of a bowl.

FIG. 2 is an enlarged perspective diagram of an opening portion 39 on the one end side in the rotation axis L direction of the bowl extension 3B. The opening portion 39 has a circular shape and a plurality of extension lugs 33 are provided in a standing manner at an edge portion thereof, the plurality of extension lugs 33 being circumferentially spaced from one another. Each of the extension lugs 33 is a projection portion having a half-tube shape as viewed in the axis direction. The distal end side in the rotation axis L direction of each of the extension lugs 33 is formed in a stepped shape in which a distal end portion is smaller.

Each of the extension lugs 33 includes a curved surface portion 331 having an arched shape bulging toward the rotation axis L and an outer surface 332 located on the outer side in a radial direction from the rotation axis L. Opposite end portions of the outer surface 332 are connected to opposite end portions of the relevant curved surface portion 331 in a longitudinal direction of the extension lug 33 (see FIG. 2) perpendicular to the rotation axis L direction.

In the present embodiment, the outer surface 332 is formed so as to be flat. In the outer surface 332, two screw holes 333 arranged in the rotation axis L direction are formed on one end side in the longitudinal direction of the extension lug 33. Bolts 54 (FIG. 5), which are tools for fixing the relevant wear-resistant sleeve 5, are threadably connected to the screw holes 333. For the bolts 54, for example, hex socket bolts can be used. For the tools for fixing the wear-resistant sleeve 5, any appropriate bolts can be used as long as the bolts are capable of being detachably fastened to the wear-resistant sleeve 5 and the extension lug 33.

Figure 3:
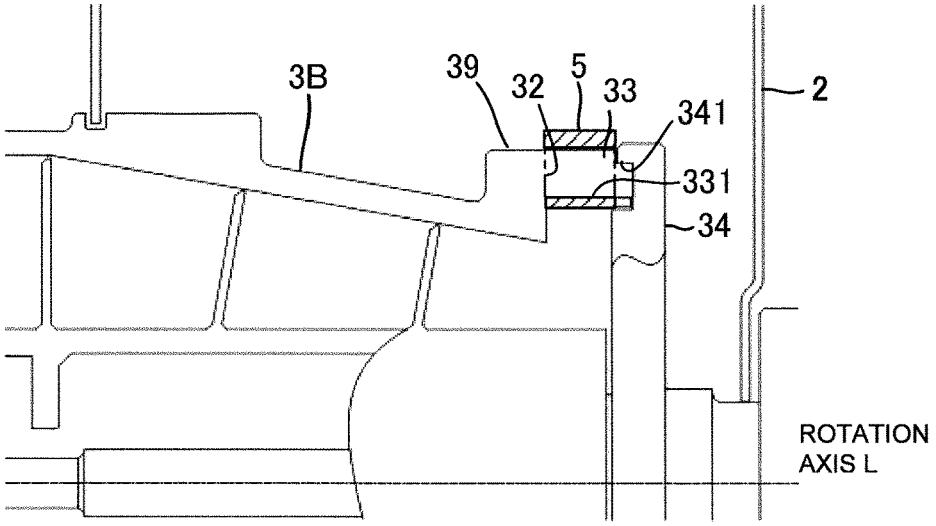
FIG. 3 is an enlarged sectional side view illustrating the opening portion and a hub of the bowl.

FIG. 3 is an enlarged sectional side view illustrating a part of the opening portion 39 and the hub 34 of the bowl 3. The hub 34 is attached to the opening portion 39. The hub 34 is connected to the extension lugs 33 and covers the opening portion 39. A plurality of holes 341 having an inner shape that is similar to an outer shape of the distal end portions of the extension lugs 33 are formed in the hub 34. The distal end portions of the extension lugs 33 are inserted in the respective holes 341. The hub 34 forms the solid matter discharge ports 32 between the respective circumferentially adjacent extension lugs 33 (see FIG. 2).

Solid matter discharged to areas corresponding to the solid matter discharge ports 32 in the solid matter separated from the processing subject in the bowl 3 and conveyed to the one end side of the bowl 3 is discharged as it is from the solid matter discharge ports 32 by the centrifugal force. On the other hand, solid matter discharged to areas corresponding to the extension lugs 33 in the solid matter conveyed to the one end side of the bowl 3 is slid on the curved surface portions 331 by the centrifugal force and discharged from the solid matter discharge ports 32. The configuration of the present embodiment enables discharging solid matter into the casing 2 in a direction of 360° around the rotation axis L. Since the extension lugs 33 are protected by the wear-resistant sleeves 5, a decrease in thickness of the extension lugs 33 due to sliding wear can be suppressed. Also, enabling of 360° discharge eliminates the need to increase the opening area of each of the solid matter discharge ports 32 in order to expand the area of discharge of solid matter (in other words, eliminate the need to increase a diameter of the bowl 3).

Figure 4:
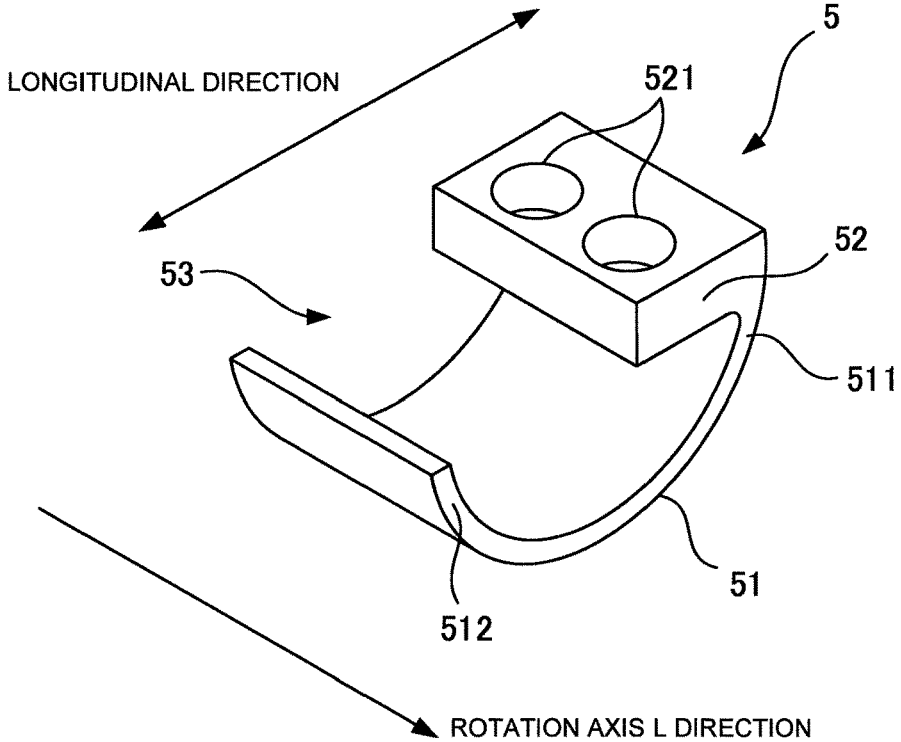
FIG. 4 is a perspective diagram illustrating a wear-resistant sleeve.

FIG. 4 is a perspective diagram of a wear-resistant sleeve 5. The wear-resistant sleeves 5 are desirably formed of a material that is stiffer than a base material of the extension lugs 33. As the material that is stiffer than the base material of the extension lugs 33, for example, IGETALLOY (registered trademark), which is a cemented carbide, can be used. However, it is possible that: the wear-resistant sleeves 5 may be formed using a material that is similar to that of the extension lugs 33; and a weld layer having high wear resistance is formed on surfaces of the wear-resistant sleeves 5. Enhancement in wear resistance of the wear-resistant sleeves 5 enables prolonging a cycle of replacement of the wear-resistant sleeves 5. Each wear-resistant sleeve 5 includes a sleeve body 51 and a claw portion 52.

The sleeve body 51, which is formed in an arched shape along the corresponding curved surface portion 331, is formed in a plate-like shape, a width in the rotation axis L direction of which is constant in a longitudinal direction perpendicular to the rotation axis L direction. An end of the claw portion 52 is provided in an integrated manner so as to be continuous with one end portion 511 in the longitudinal direction (end portion on the right side in FIG. 4) of the sleeve body 51.

The claw portion 52 has a rectangular parallelepiped shape that is longer in the rotation axis L direction. The claw portion 52 is provided so as to be continuous with the sleeve body 51 in a position in which the claw portion 52 is flexed inward from the one end portion 511 of the sleeve body 51. An insertion opening 53 is formed between another end located on the left side in FIG. 4 of the claw portion 52 and another end portion 512 located on the left side in FIG. 4 of the sleeve body 51.

Although described later, the insertion opening 53 is intended to allow the corresponding extension lug 33 to be inserted to the inner sides of the sleeve body 51 and the claw portion 52 when the sleeve body 51 is inserted into the corresponding solid matter discharge port 32 from the other end portion 512 side to set the sleeve body 51 on the curved surface portion 331. The claw portion 52 includes two hole portions 521 that receive respective head portions of the bolts 54.

Figure 5:
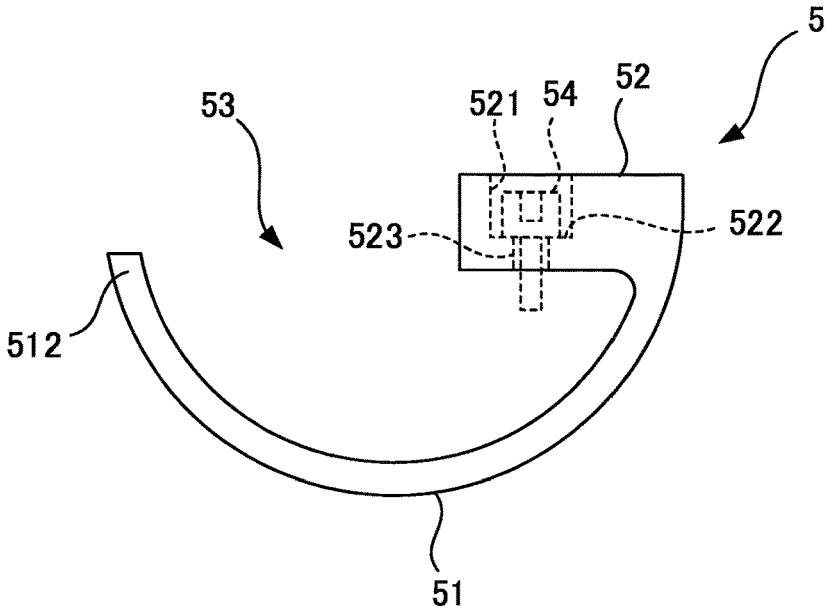
FIG. 5 is a side view of a wear-resistant sleeve for describing hole portions.

FIG. 5 is a side view of a wear-resistant sleeve 5 for describing the hole portions 521. A bottom surface 522 of each hole portion 521 serves as a seating surface of a head portion of a bolt 54. The bottom surface 522 includes a bolt hole 523 that allows a shaft portion of the bolt 54 to extend therethrough. The claw portion 52 is formed so as to be thicker than the sleeve body 51 in the longitudinal direction of the wear-resistant sleeve 5. Here, in a state in which the bolt 54 is fastened, the head portion of the bolt 54 is received at a position that is lower than an upper end of the hole portion 521. In other words, the head portion of the bolt 54 is buried in the claw portion 52, enabling preventing the head portion of the bolt 54 from being ground by the solid matter discharged from the solid matter discharge ports 32.

Figure 6:
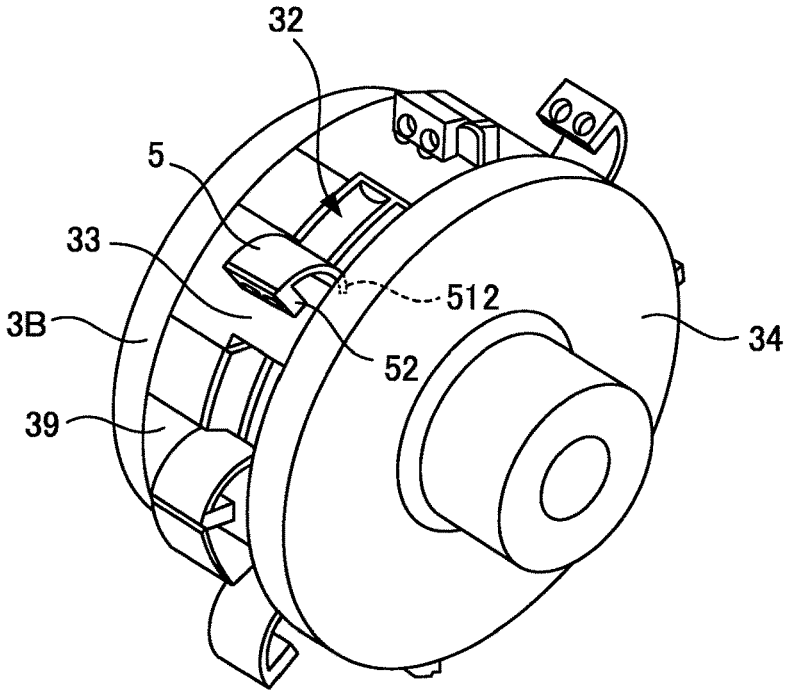
FIG. 6 is a perspective diagram illustrating positions of wear-resistant sleeves when attached.
Figure 7:
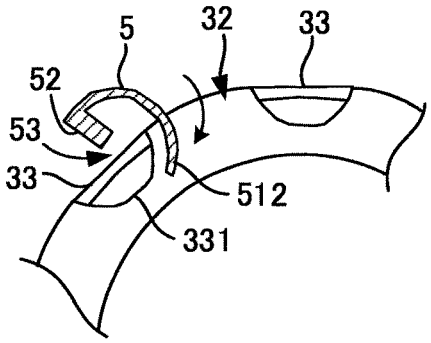
FIGS. 7(A)-(E) include diagrams for describing a method for attachment of a wear-resistant sleeve to a lug.
Figure 7B:
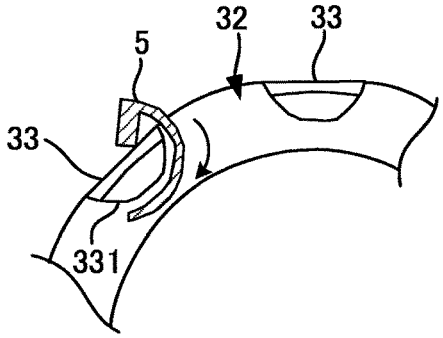
Figure 7:
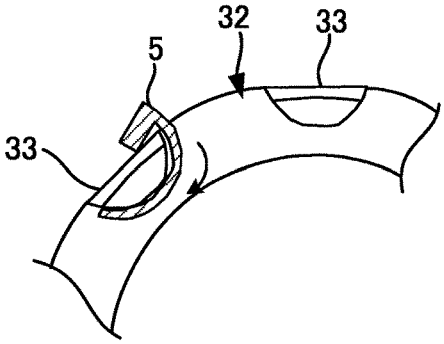

FIG. 6 is a perspective diagram illustrating positions of the wear-resistant sleeves 5 when attached. When the wear-resistant sleeves 5 are attached to the extension lugs 33, the wear-resistant sleeves 5 are inserted to the respective solid matter discharge ports 32 from the other end portion 512 side on which no claw portion 52 is formed. As illustrated in FIGS. 7(A) to 7(C), while the one end side of each extension lug 33 is inserted to the insides of the claw portion 52 and the sleeve body 51 from the insertion opening 53, the wear-resistant sleeve 5 is turned along the curved surface portion 331 of the extension lug 33.

Figure 7D:
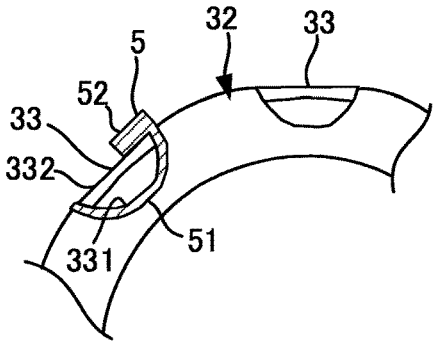
Figure 7E:
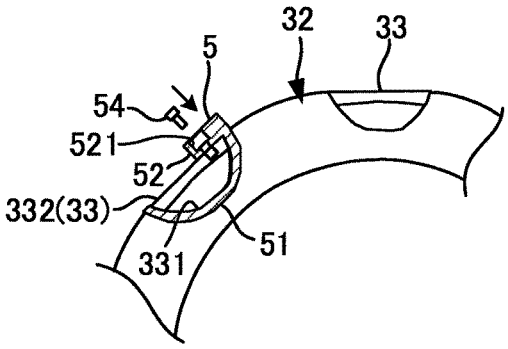

As illustrated in FIG. 7(D), the wear-resistant sleeve 5 is turned until the one end side of the extension lug 33 is inserted to the insides of the claw portion 52 and the sleeve body 51 and the sleeve body 51 is brought into a position in which the sleeve body 51 covers the entire curved surface portion 331. In this state, a bottom surface of the claw portion 52 is in surface contact with the outer surface 332 of the extension lug 33 (also see FIG. 8). Subsequently, as illustrated in FIG. 7(E), the claw portion 52 is fixed to the outer surface 332 of the extension lug 33 by inserting bolts 54 to the hole portions 521 and fastening the bolts 54. Consequently, the wear-resistant sleeve 5 is fixed to the extension lug 33 and the sleeve body 51 is thereby set on the curved surface portion 331.

When the wear-resistant sleeve 5 is detached, a procedure that is reverse of the procedure in FIGS. 7(A) to 7(E) may be performed. In other words, after the bolts 54 being removed from the wear-resistant sleeve 5, the wear-resistant sleeve 5 is turned in a direction that is opposite to the aforementioned direction so as to make the extension lug 33 come off from the insertion opening 53, enabling the wear-resistant sleeve 5 to be detached from the extension lug 33.

As described above, in the present embodiment, the wear-resistant sleeves 5 can easily be attached to/detached from the extension lugs 33 without removal of, e.g., the hub 34 of the bowl 3. In other words, upon the casing 2 being opened, the head portions of the bolts 54 can be viewed, and thus, replacement of the wear-resistant sleeves 5 can easily be performed by engaging a hexagonal wrench with the head portion of each bolt 54 and unfastening the bolt 54. Here, as described above, the head portion of each bolt 54 is buried in the corresponding claw portion 52, and thus, the problem of, e.g., a failure to engage a hexagonal wrench due to the head portion of the bolt 54 being worn away is less likely to occur in the replacement.

Second Embodiment

Figure 9:
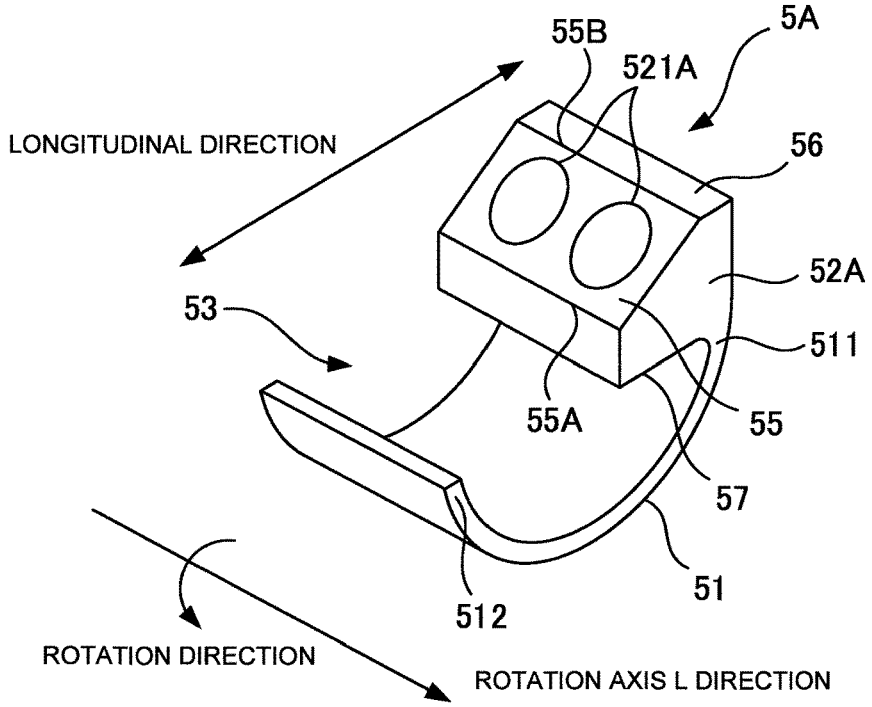
FIG. 9 is a perspective diagram illustrating a wear-resistant sleeve according to a second embodiment.

FIG. 9 is a perspective diagram illustrating a wear-resistant sleeve 5A. A claw portion 52A of the wear-resistant sleeve 5A has a shape formed by addition of a reinforcement portion having a trapezoidal shape in a side view to a claw portion 52 of the first embodiment. A plan shape of the claw portion 52A is a rectangular shape that is the same in size as the claw portion 52. A size of insertion openings 53 is the same as that of the first embodiment.

Each claw portion 52A includes an inclined surface 55 and a top surface 56. The inclined surface 55 includes a front end portion 55A, in a direction of rotation of a bowl 3, inclined so as to be disposed at a position closer to a rotation axis L relative to a rear end portion 55B. The inclined surface 55 includes two hole portions 521A that receive respective head portions of bolts 54. With reference to FIG. 5, a bolt hole 523 is provided in a bottom surface 522 of each hole portion 521A.

In a longitudinal direction of the wear-resistant sleeve 5A, the other end side (left side in FIG. 9) of the top surface 56 is connected to one end side (right end in FIG. 9) of the inclined surface 55 and one end (right end in FIG. 9) of the top surface 56 is one end of the wear-resistant sleeve 5A. The top surface 56 is parallel to a bottom surface 57 of the claw portion 52A.

A part of solid matter discharged from solid matter discharge ports 32 is deposited on an inner surface of a casing 2 and thus grows toward the bowl 3. If the deposited solid matter further grows, the bowl 3 may be damaged as a result of the deposited solid matter coming into contact with the bowl 3 that is rotating. According to the configuration of the present embodiment, the inclined surface 55 is formed so as to face the direction of rotation of the bowl 3, and thus, the solid matter deposited on the inner surface of the casing 2 can be scratched off by making the inclined surfaces 55 of the claw portions 52A collide with the solid matter. Consequently, the grown solid matter can be prevented from coming into contact with an outer circumferential surface of the bowl 3.

Third Embodiment

Figure 10:
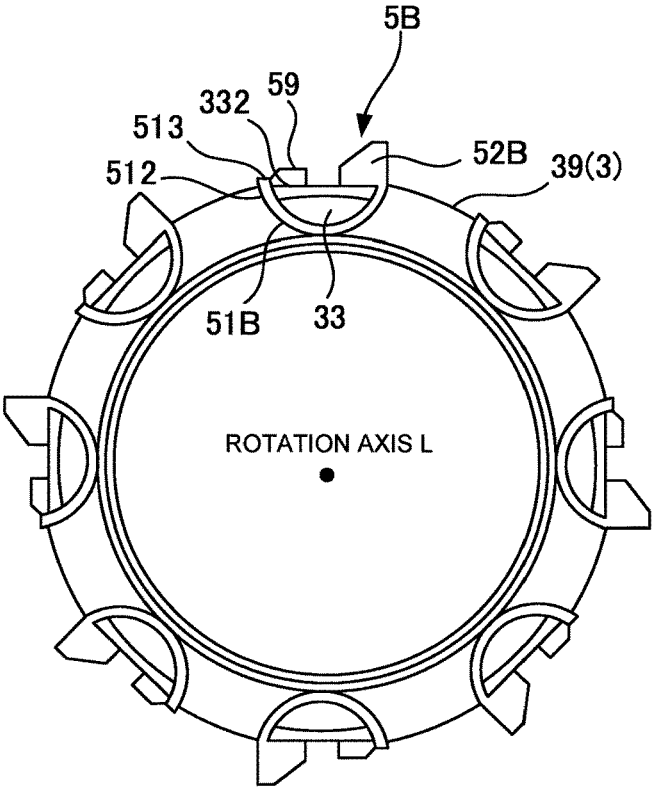
FIG. 10 is a side view of wear-resistant sleeves according to a third embodiment.
Figure 11:
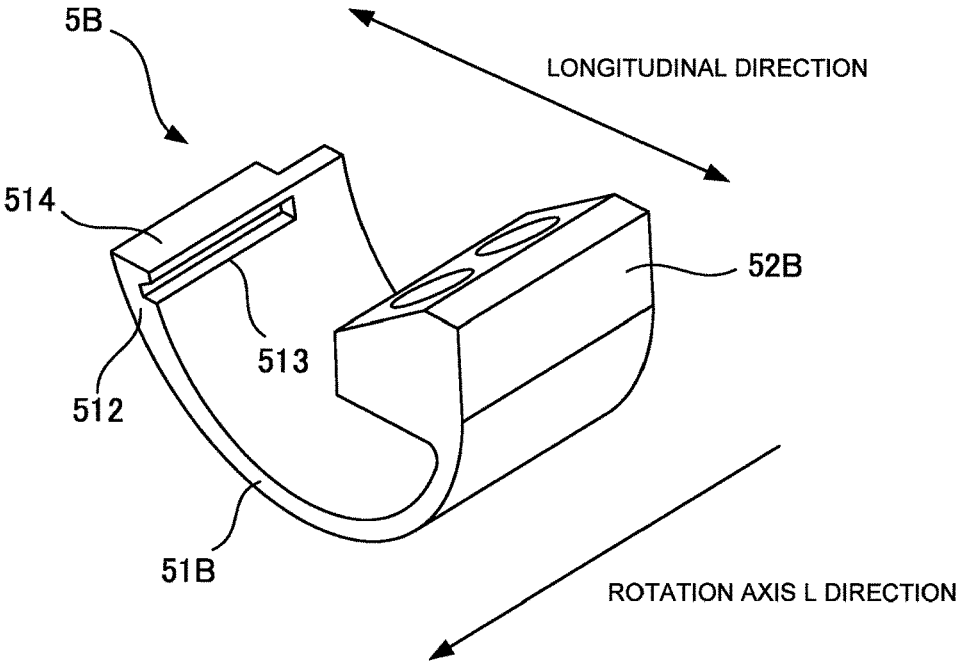
FIG. 11 is a perspective diagram illustrating a keyway.

FIG. 10 is a side view illustrating wear-resistant sleeves 5B. In the present embodiment, other end portions 512 of wear-resistant sleeves 5B are located on the outer side in a radial direction of a bowl 3 relative to outer surfaces 332 of extension lugs 33. As illustrated in FIG. 11, a keyway 513 extending in the rotation axis L direction is formed in an inner surface of each of the other end portions 512 located on the outer side in the radial direction. The keyway 513 is located on an end side in the rotation axis L direction of a sleeve body 51B. In the rotation axis L direction, a width (length) of the keyway 513 is smaller than a width of the sleeve body 51B. A claw portion 52B on one end side (right side in FIG. 11) of the sleeve body 51B is the same as the claw portion 52A of the second embodiment.

Figure 12:
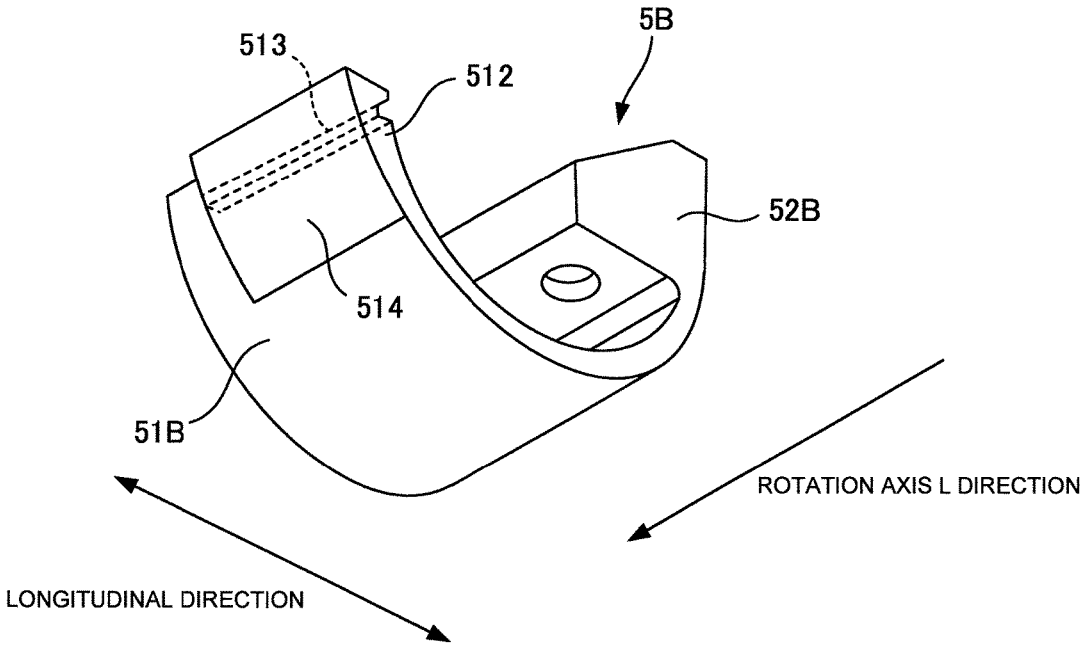
FIG. 12 is a perspective diagram illustrating a thickened portion.

FIG. 12 is a perspective diagram illustrating a thickened portion 514. The thickened portion 514 having a width corresponding to the width of the keyway 513, that is, a width that is the same or slightly larger than the width of the keyway 513 is formed on the other end side (left side in FIG. 11) of the sleeve body 51B. The thickened portion 514 has a thickness increasing toward an end side in a longitudinal direction of the wear-resistant sleeve 5B as is closer to the distal end side of the other end portion 512 of the sleeve body 51B.

Figure 13:
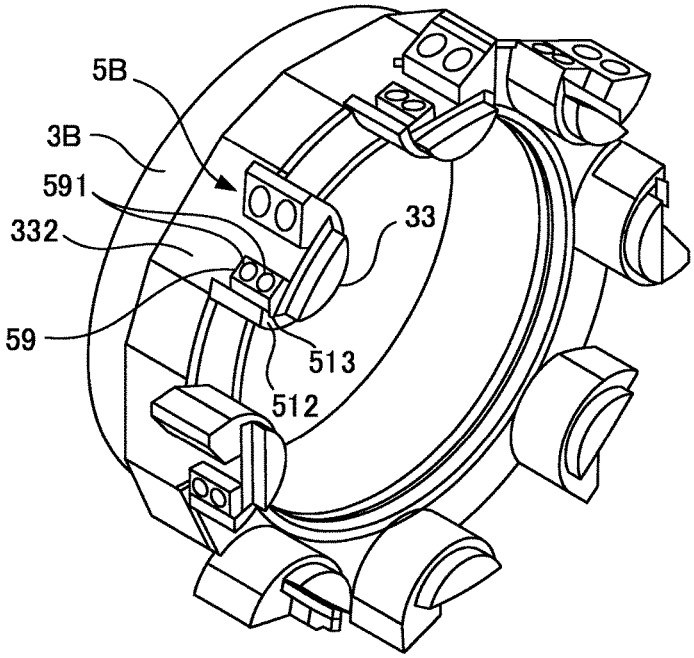
FIG. 13 is a perspective diagram illustrating keys.

FIG. 13 is a perspective diagram illustrating keys 59. In a state in which wear-resistant sleeves 5B are fitted on the respective extension lugs 33, a key 59 is inserted to each keyway 513. The key 59 has a trapezoidal shape in a side view (view in the axis L direction), which has an inclined surface only on one end side, and includes two hole portions 591 in a top surface thereof. Each hole portion 591 receives a head portion of a non-illustrated hex socket bolt. A bottom surface of the hole portion 591 includes bolt holes that allow shaft portions of the respective bolts to extend therethrough. Two non-illustrated screw holes corresponding to the hole portions 591 are formed in an outer surface 332 of the corresponding extension lug 33.

In a state in which the key 59 is inserted in the keyway 513, a bottom surface of the key 59 is in surface contact with the outer surface 332 of the extension lug 33. Then, the bolts are inserted to the hole portions 591 and the bolts are threadably connected to the screw holes on the extension lug 33 side. Consequently, the key 59 fixes the other end portion 512 of the sleeve body 51B to the extension lug 33.

In the present embodiment, the other end portions 512 of the sleeve bodies 51B are fixed via the keys 59, enabling opposite end portions 511, 512 of the sleeve bodies 51B to be firmly fixed to the extension lugs 33.

In the present embodiment, since the other end portions 512 of the sleeve bodies 51B are reinforced by the thickened portions 514, it is possible to ensure a strength of the other end portions 512 of the sleeve bodies 51B even though the keyways 513 are provided in the other end portions 512.

(Alteration)

Figure 14:
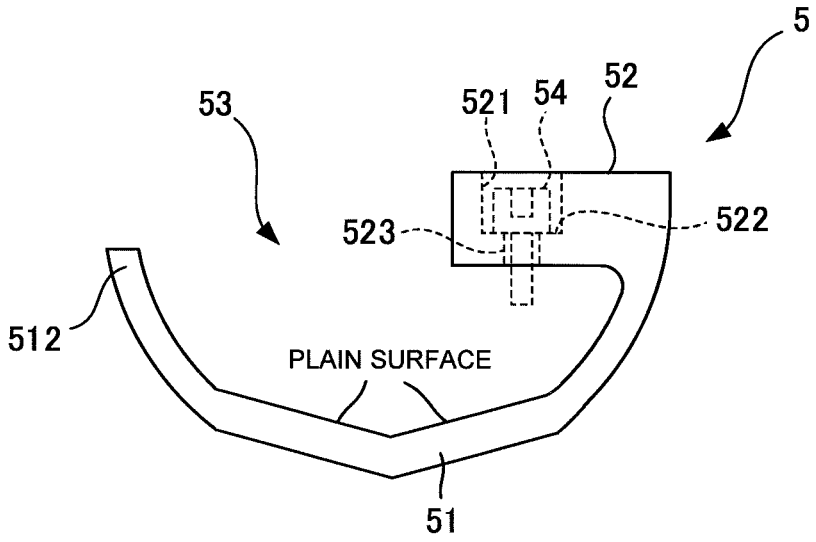
FIG. 14 is a diagram of a wear-resistant sleeve according to an alteration.

Although in the above-described embodiment, an inner surface of each wear-resistant sleeve 5 is formed according to the corresponding curved surface portion 331, another shape except for curved shape may be employed as long as such shape enables solid matter to move toward solid matter discharge ports 32. In other words, as illustrated in FIG. 14, a part (or an entirety) of the curved surface 331 may be changed to a structure connected with flat surfaces.

REFERENCE SIGNS LIST

1 decanter
3 bowl
3A bowl shell
3B bowl extension
4 screw conveyer
5, 5A, 5B wear-resistant sleeve
32 solid matter discharge port (separate matter discharge port)
33 extension lug
34 hub
39 opening portion
51, 51A, 51B sleeve body
52, 52A, 52B claw portion
53 insertion opening
54 bolt (tool for fixing)
55 inclined surface of claw portion
59 key
331 curved surface portion
332 outer surface
333 screw hole
511 one end portion of sleeve body
512 other end portion of sleeve body
513 keyway
514 thickened portion
521 hole portion
522 bottom surface of hole portion
523 bolt hole

The invention claimed is:

1. A centrifugal apparatus comprising:

a bowl including a plurality of extension lugs formed at an edge portion of an opening portion of the bowl on one end side of the bowl in an axis direction, the plurality of extension lugs being spaced from one another in a circumferential direction, each of the extension lugs being formed so as to bulge toward a rotation axis of the bowl;

a screw conveyer that is rotatably housed inside the bowl and rotates at a rotation speed that is different from that of the bowl;

a hub for forming solid matter discharge ports respectively between circumferentially adjacent extension lugs, the hub being connected to the extension lugs and covering the opening portion; and wear-resistant sleeves respectively coupled to the extension lugs without use of an adhesive, each sleeve including a sleeve body covering an inner surface of a corresponding extension lug such that solid matter moving toward an adjacent one of the solid matter discharge ports slides on the sleeve body covering the inner surface of the extension lug, and a claw portion provided in an integrated manner on one end side of the sleeve body, the claw portion being detachably fixed via a bolt to an outer surface of the extension lug, wherein no solid matter slides on the outer surface of the extension lug, and wherein the bolt has a head portion and a shaft portion extending from the head portion, and a distal end of the shaft portion is located inside the extension lug without protruding from the extension lug.

2. The centrifugal apparatus according to claim 1, wherein the claw portion includes a hole portion that receives the head portion of the bolt, a bottom surface of the hole portion serves as a seating surface of the head portion, the bottom surface includes a bolt hole that allows the shaft portion of the bolt to extend therethrough and the head portion of the bolt is received at a position that is lower than an upper end of the hole portion.

3. The centrifugal apparatus according to claim 2, wherein:

another end portion of the sleeve body is located on an outer side in the radial direction relative to the outer surface and a keyway is provided in an inner surface of the other end portion; and a key that is in contact with the outer surface and fixes the other end portion of the sleeve body to the extension lug is inserted in the keyway.

4. The centrifugal apparatus according to claim 3, wherein:

in the axis direction, a width of the keyway is smaller than a width of the sleeve body; and a thickened portion having a width corresponding to the width of the keyway is formed on the other end side of the sleeve body.

5. The centrifugal apparatus according to claim 1, wherein the claw portion includes an inclined surface in which a front end portion in a direction of rotation of the bowl is closer to the rotation axis relative to a rear end portion of the inclined surface.

6. The centrifugal apparatus according to claim 2, wherein the claw portion includes an inclined surface in which a front end portion in a direction of rotation of the bowl is closer to the rotation axis relative to a rear end portion of the inclined surface.

7. The centrifugal apparatus according to claim 3, wherein the claw portion includes an inclined surface in which a front end portion in a direction of rotation of the bowl is closer to the rotation axis relative to a rear end portion of the inclined surface.

8. The centrifugal apparatus according to claim 4, wherein the claw portion includes an inclined surface in which a front end portion in a direction of rotation of the bowl is closer to the rotation axis relative to a rear end portion of the inclined surface.

* * * * *